United States Patent [19]

Calkoen

[11] Patent Number: 5,007,352

[45] Date of Patent: Apr. 16, 1991

[54] PALLET CONSTRUCTION

[75] Inventor: Guido M. Calkoen, Glen Waverley, Australia

[73] Assignee: Design Count Pty. Ltd., Australia

[21] Appl. No.: 209,582

[22] Filed: Jun. 22, 1988

[30] Foreign Application Priority Data

Jun. 22, 1987 [AU] Australia ..... PI02603

[51] Int. Cl.[5] ..... B65D 19/12

[52] U.S. Cl. ..... 108/56.1; 108/902

[58] Field of Search ..... 108/56.1, 57.1, 51.1, 108/53.1, 53.3, 54.1, 91, 92, 901, 902; 206/599, 600; 411/405

[56] References Cited

U.S. PATENT DOCUMENTS

| | | | |
|---|---|---|---|
| 1,330,098 | 2/1920 | Smith | 411/405 |
| 2,930,560 | 3/1960 | Carnwath et al. | 108/56.1 |
| 3,650,224 | 3/1972 | Petix et al. | 108/901 X |
| 3,824,933 | 7/1974 | Lind | 108/902 X |
| 3,835,792 | 9/1974 | Wharton | 108/902 X |
| 3,868,915 | 3/1975 | Hafner | 188/901 X |
| 4,000,704 | 1/1977 | Griffin, Jr. | 100/53.1 |
| 4,413,737 | 11/1983 | Wind | 108/53.1 X |
| 4,674,414 | 6/1987 | Nülle et al. | 108/901 X |
| 4,694,962 | 9/1987 | Taub | 108/56.1 X |

*Primary Examiner*—Jose V. Chen

*Attorney, Agent, or Firm*—Banner, Birch, McKie & Beckett

[57] ABSTRACT

Load bearing pallet construction which avoids problems associated with conventional wood constructions. The pallet construction consists of a plurality of pallet forming members, arranged in two layers and defining lift fork receiving openings between the two layers. Each of the pallet forming members has a length equal to a width dimension of the pallet construction with the direction of pallet forming members in one of the layers being crossed relative to the direction of the pallet forming members in the other of the layers. Fasteners connect together pallet forming members in the two layers.

9 Claims, 6 Drawing Sheets

SECTION K-K

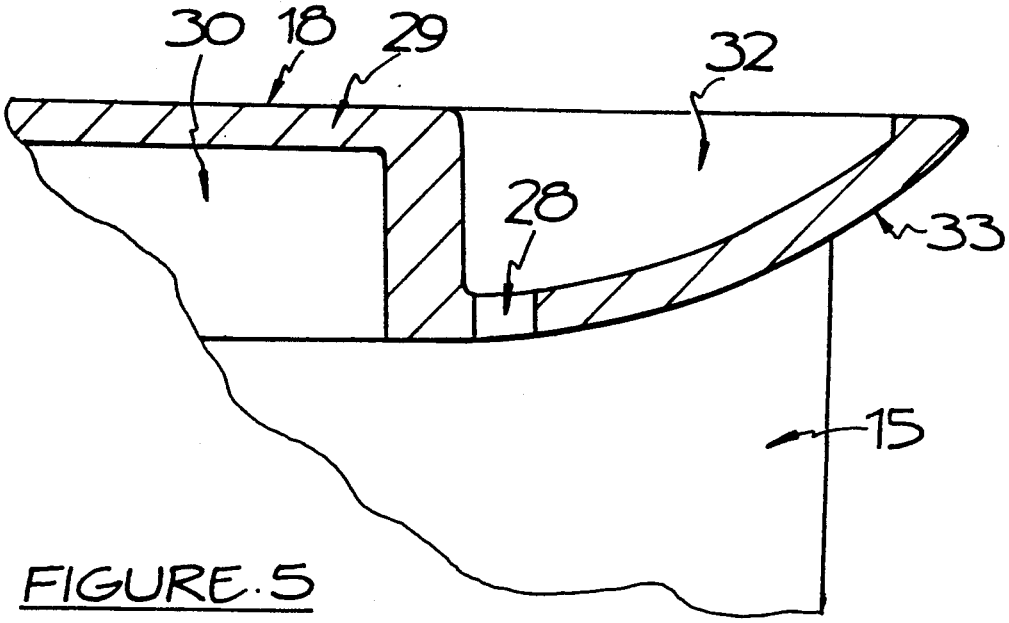
FIGURE. 5
FIGURE. 6A
FIGURE. 6B
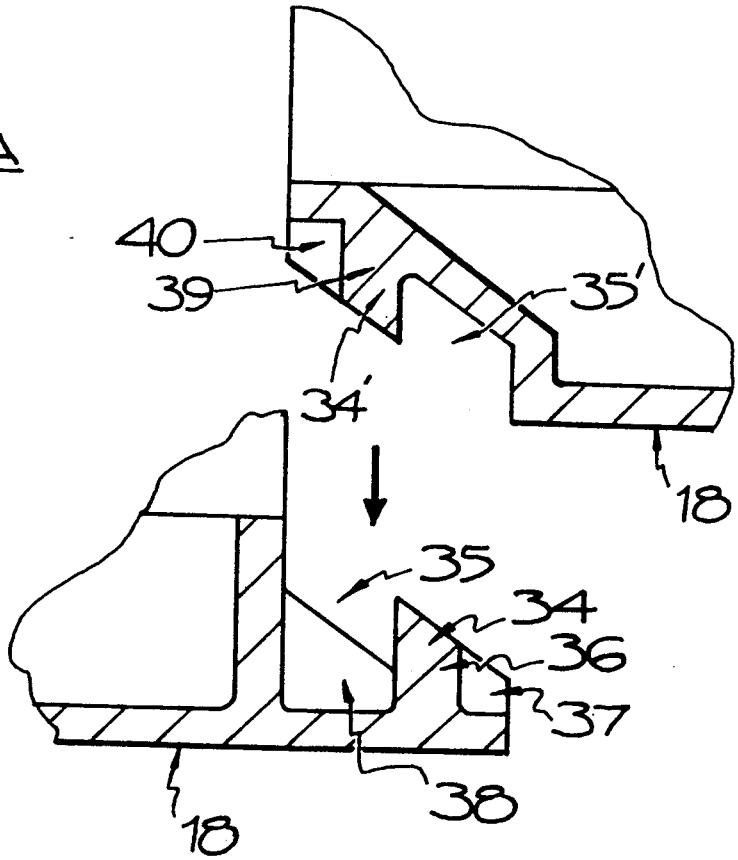

FIGURE.7
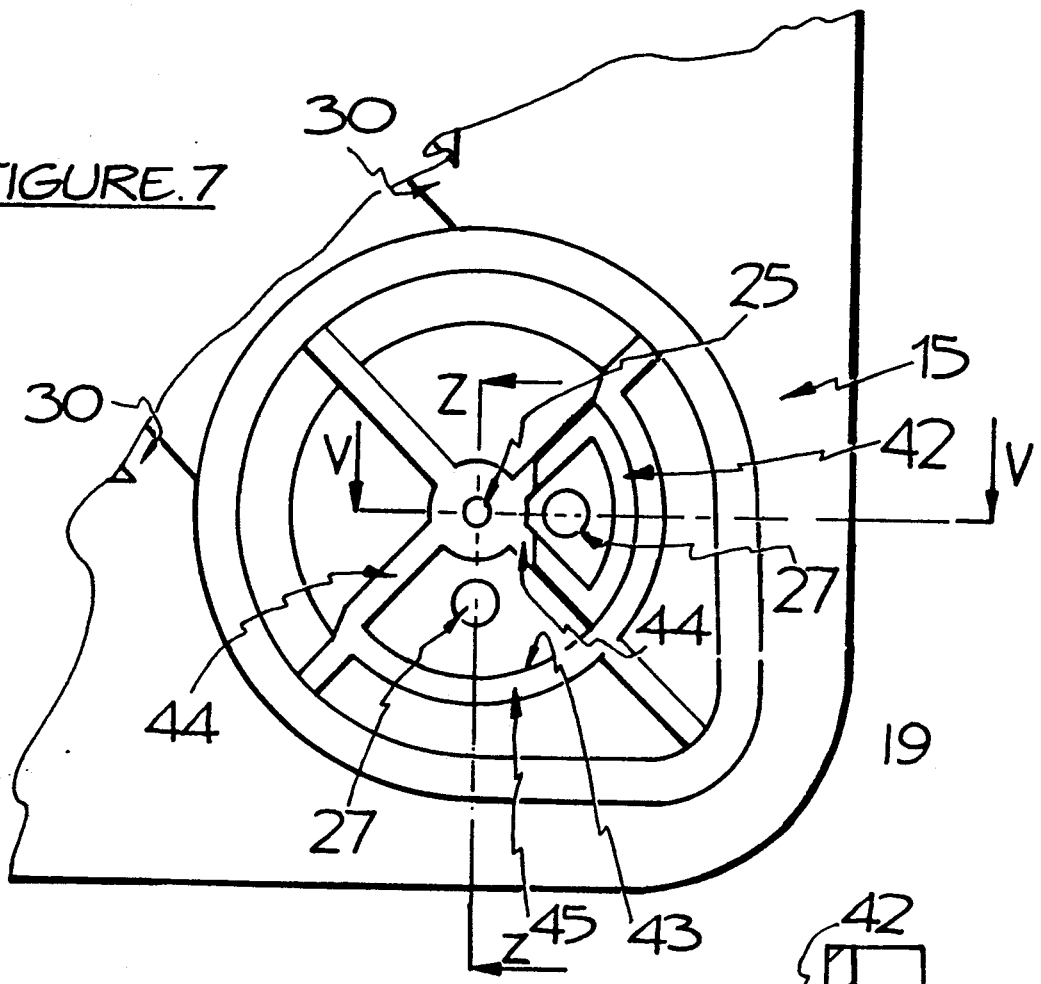
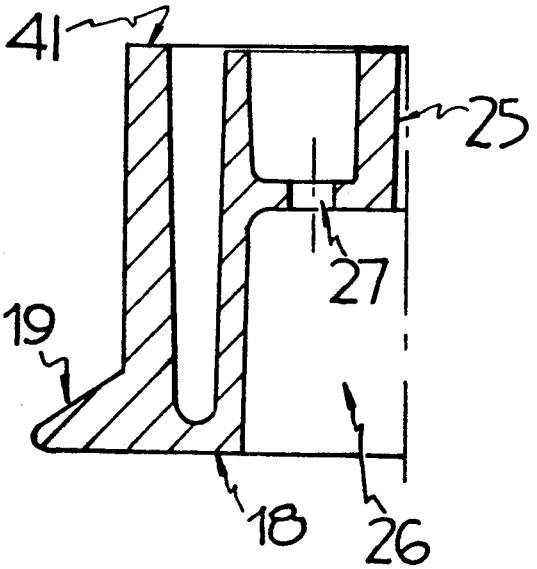
FIGURE.8
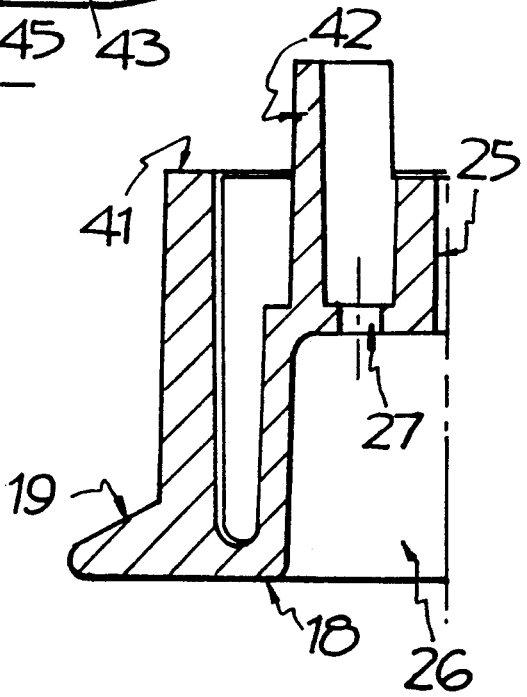
FIGURE.9

PALLET CONSTRUCTION

The present invention relates to pallets and more particularly to an improved pallet construction made from plastics material.

Conventionally loading pallets for use with fork lift trucks or the like have been produced from wood. While these pallets have generally proved satisfactory, they remain reasonably expensive to produce and, moreover, there are a number of situations, particularly in food industries, where wood pallets are not desirable. For example, wood pallets cannot be cleaned or sterilized when it might be necessary to do so in certain industries. Pallets produced from plastics materials have been developed for use in situations where wood pallets are not suitable or desirable. These have generally been single piece mouldings of complex design which have been very expensive to produce. Moreover, pallets of this type can become damaged relatively easily. Usually the damage is localized in a small area but because the pallet is of one piece construction, the whole pallet has to be scrapped because it cannot be repaired as with wooden pallets.

The objective of the present invention is to provide an improved construction for a plastics material pallet which will be less complex in design and therefore less expensive to produce than currently known designs, while providing some capability of being repaired in situations of localized damage.

In accordance with the present invention there is provided a pallet construction comprising a plurality of pallet forming members arranged in two layers and defining fork receiving openings between said two layers, each said pallet forming member having a length equal to the width of the pallet with the direction of said pallet forming members in one of said layers being crossed relative to the direction of said pallet forming members in the other of said layers, and fastening means being provided to connect together pallet forming members in said two layers.

Conveniently the fastening means may be separate screws, bolts or other similar members arranged such that the fastening means connect each said pallet forming member in said one layer to all of the pallet forming members in said other layer. Preferably, each of the pallet forming members is integrally molded from synthetic resin or plastics material. Conveniently, this may be recycled waste plastics material. Advantageously the pallet forming members in said one layer are arranged at 90° to the pallet forming members in the other layer.

Conveniently the pallet forming members are of identical configuration thereby minimizing the costs of production. That is, only one mold would be needed. In accordance with a particularly preferred arrangement, each of the pallet forming members comprises a substantially rectangular platform section with a first surface adapted to form an outer surface of the pallet construction and a second surface opposed to said first surface adapted to form an inner surface of said pallet construction, and a plurality of separate boss members extending from said second surface, said boss members being located at or adjacent each corner of said platform section and at or adjacent opposed longitudinal edges of said platform section midway along said longitudinal edges. A first one of the longitudinal edges of each said pallet forming member may include engagement formations engageable with similar engagement formations on an adjacent said pallet forming member when assembled into said pallet construction, said engagement formations preventing separation of said pallet forming members by movement of said members away from one another in the same plane. Conveniently, the engagement formations on each said pallet forming member are formed by adjacent sections of equal length, the engagement formations in said adjacent sections being oppositely directed.

In accordance with another aspect of the present invention, there is provided a pallet forming member for producing a pallet construction as defined in the foregoing, said pallet forming member comprising a substantially rectangular plate section having a length substantially twice its width with a first surface adapted to form an outer surface of the pallet construction and a second surface opposed to said first surface of said pallet construction, a plurality of boss members extending from said second surface with free engagement end surfaces located in the same plane, said boss members being located at or adjacent each corner of said plate section and at or adjacent opposed longitudinal edges of said plate section midway along said longitudinal edges.

One preferred embodiment of the present invention will be described hereinafter with reference to the accompanying drawings, in which:

FIG. 5 is a partial sectional view taken along line X—X of FIG. 2;

FIGS. 6A and 6B are partial cross-sectional views through one edge of respective pallet forming members showing engagement formations adapted to connect with one another;

FIG. 7 is a detailed plan view of one corner of a pallet forming member;

FIG. 8 is a partial cross-sectional view taken along line Z—Z of FIG. 7; and FIG. 9 is a partial cross-sectional view taken along line V—V of FIG. 7.

Figure 1:
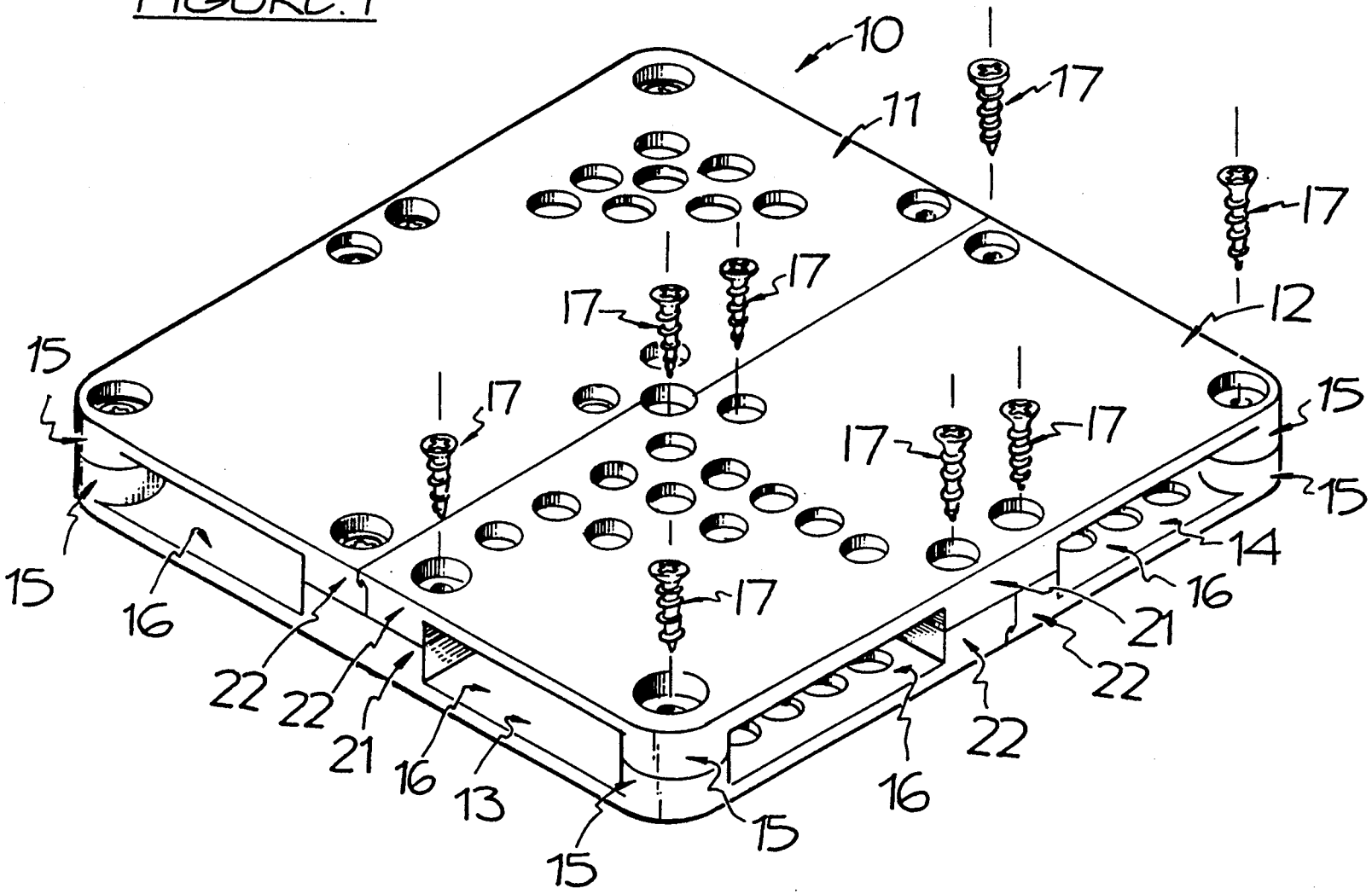
FIG. 1 is a perspective schematic view of one possible pallet construction.

FIG. 1 shows a pallet construction 10 in accordance with a preferred embodiment of the present invention. The pallet construction 10 comprises four identically molded plastics material pallet forming members 11, 12, 13 and 14. Each of these members extends over the complete width/length of an upper or lower surface of the pallet construction 10 and comprises half of that surface area. The pallet members 11, 12 forming the upper layer are crossed relative to the members 13, 14 forming the lower layer. In the embodiment illustrated the pallet members 11 and 12 are arranged at 90° to the pallet forming members 13 and 14. Integrally molded projections or bosses 15, 21, 22 and 23 are provided at or adjacent the corners and midway along the longitudinal sides of the members 11 to 14. The projections or bosses have free engagement surfaces located in a single plane such that when the members are assembled (FIG. 1), respective projections abut one another to form fork receiving cavities 16 between the upper and lower layers of the pallet construction. Fastener elements 17 of any desired type may be provided to form the pallet forming members 11 to 14 in the construction illustrated in FIG. 1.

Figure 2:
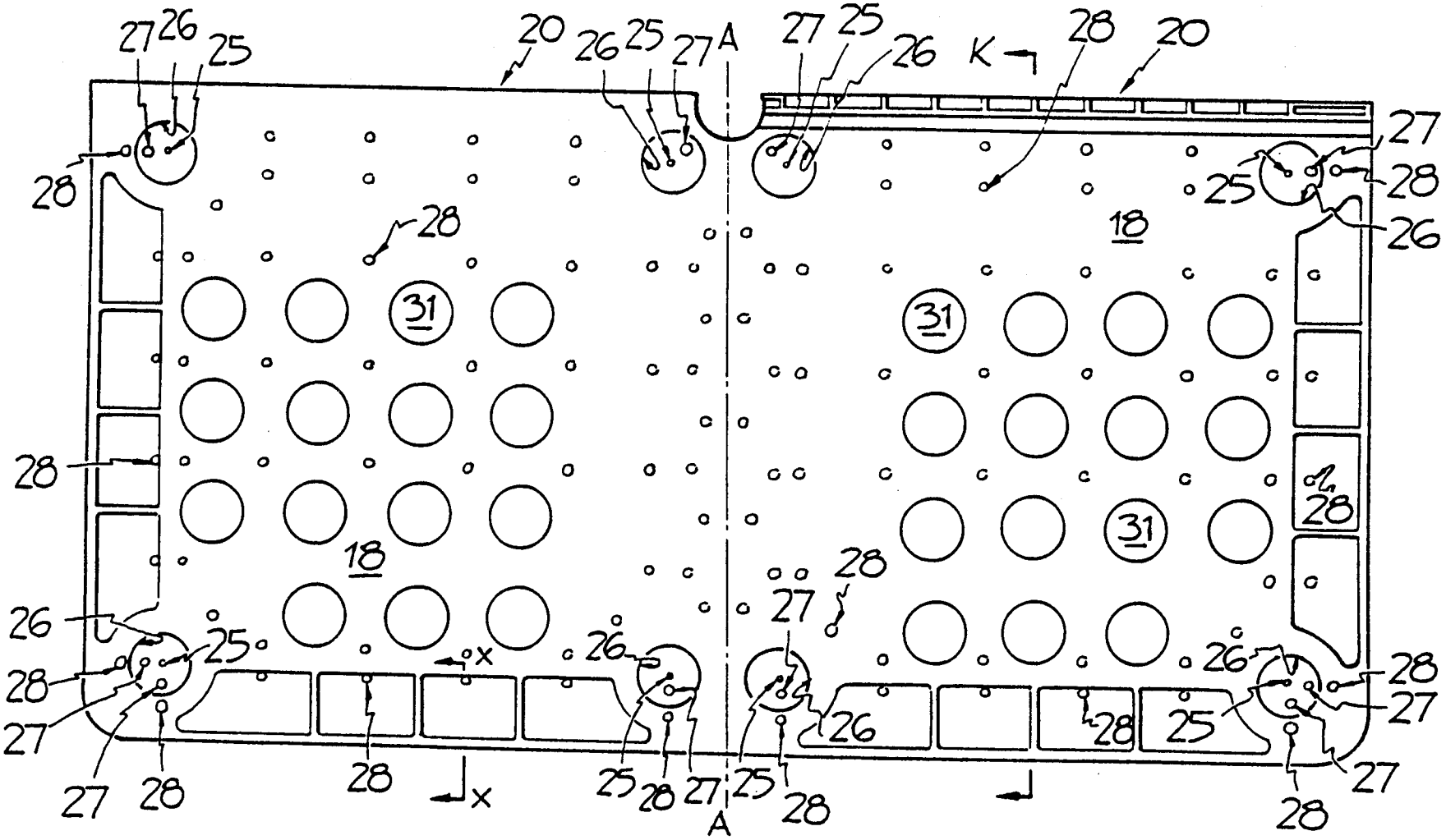
FIG. 2 is a top plan view of one preferred pallet forming member.
Figure 3:
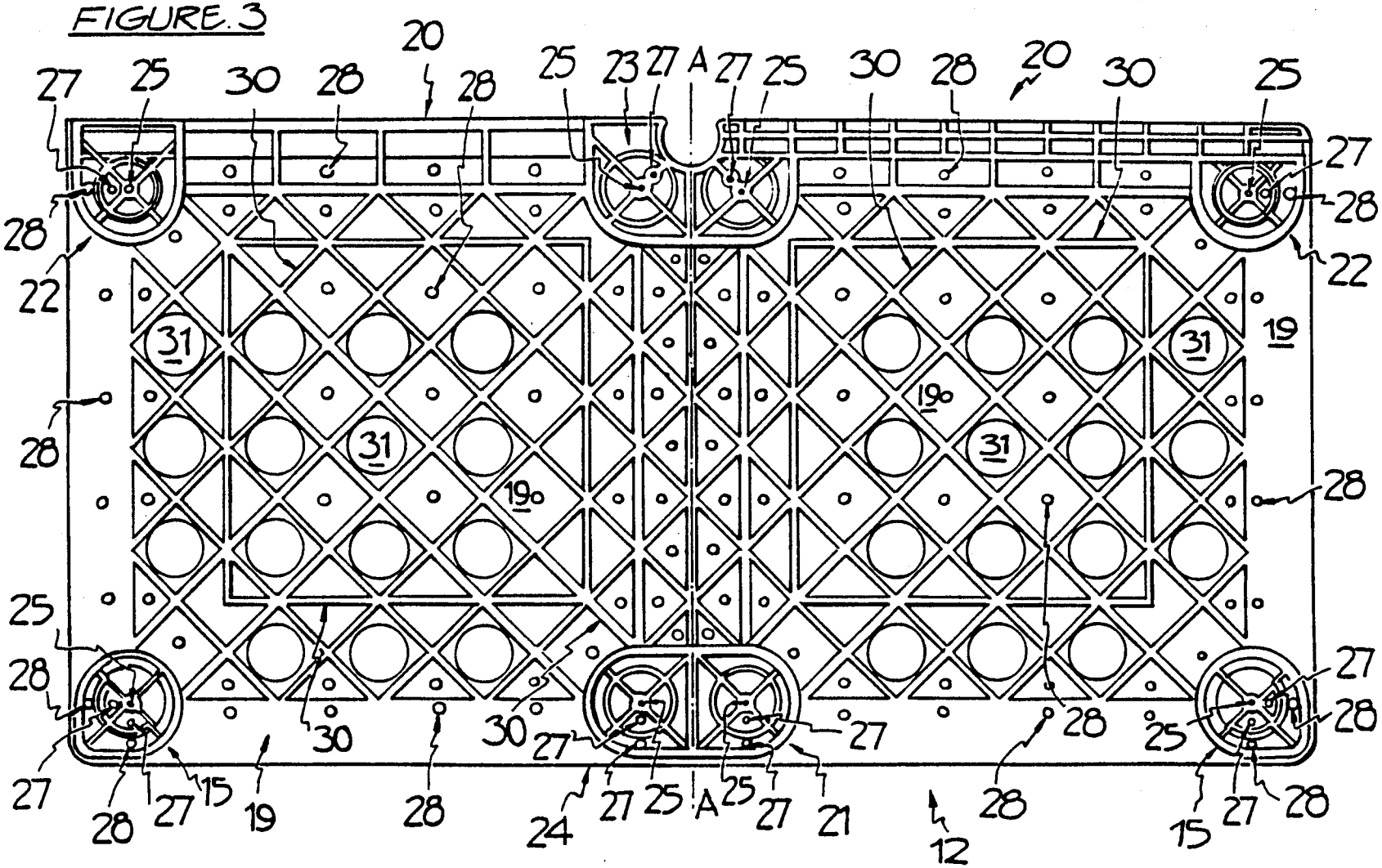
FIG. 3 is a lower plan view of the pallet forming member of FIG. 2.

FIGS. 2 to 9 illustrates in more detail one preferred form of pallet forming member. FIG. 2 illustrates a top plan view of a pallet forming member (11 to 14). The member has a first outer surface 18 adapted to form the upper or bottom outer surface of the pallet construction 10. The reverse or inner side of the pallet forming member 19 is shown in FIG. 3. As can be seen in both FIGS. 2 and 3, the configuration of the pallet forming member is identical on either side of the transverse centre line A—A with the exception of the edge engagement formations 20, 20' described in more detail hereinafter. The boss members 15, 21, 22 and 23 are configured in plan view as shown in FIG. 3. The corner boss members 15 are part circular with a projecting corner corresponding in shape with the corner of the platform formed by the section between the outer and inner surfaces 18 and 19. The other corner boss members 22 are generally U shaped in plan view and are configured to be essentially half of the boss member 23 formed spanning the center line A—A along the outer longitudinal edge 24 of the pallet forming member 12. The central boss member 23, like boss member 22 is mirror imaged on either side of the center line A—A and is configured to provide an essentially square post centrally within the pallet construction when the construction is assembled as shown in FIG. 1. Each of the corner boss members 15 and 22 have a centrally located bore 25 adapted to receive a fastener 17 therethrough to secure two pallet forming members together in the configuration shown in FIG. 1. Similar fastener receiving bores 25 are located in the central boss members 21 and 23 except, in this case two bores 25 are located on either side of the centre line A—A.

Figure 4:
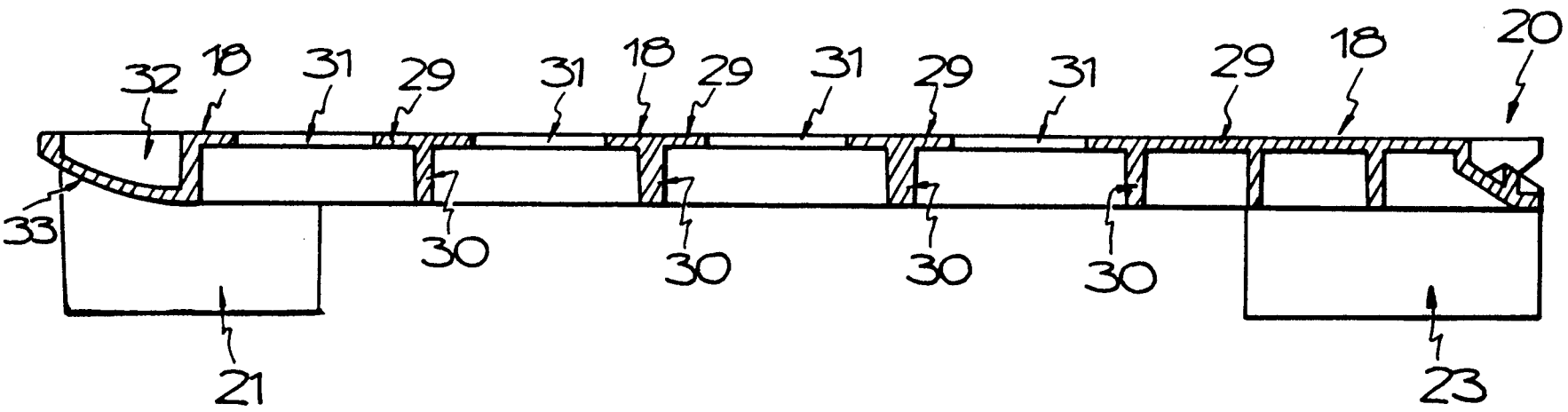
FIG. 4 is a cross-sectional view along line K—K of FIG. 2.

As best seen in FIGS. 1 and 2, the outer surface 18 includes recesses 26 surrounding the fastener receiving bores 25 to allow the head of any fastener 17 used to be recessed below the general outer plane of the surface 18. Each of the boss members 15, 21, and 23 further includes passage means 27 appropriately located to allow water or any other liquid to drain from the recesses or cavities 26. The construction of the platform section of the pallet forming member is generally to provide a solid web thickness 29 strengthened by an array of stiffening ribs 30 arranged on the inner surface 19 face of the platform section. The web thickness 29 further includes an array of larger holes 31 and smaller holes 28 to allow for drainage or water/liquid passage through the pallet construction. The larger holes 31 further effectively reduce the volume (and therefore weight) of plastics material used which reduces the cost of production and decreases the weight of the assembled pallet. As best seen in FIGS. 2, 4 and 5, the three edges of the pallet forming member 12 other than the edge with the engagement formations 20, 20' have a series of depressions or recesses 32. This permits the configuration to define a ramp like diverging surface 33 leading from the inner surface 19 along an edge zone towards the outer surface 18. This enables an effectively wider mouth region for the fork receiving recesses 16 and assists in guiding forks of a fork lift truck or the like to enter the recesses 16.

As shown in FIGS. 6A and 6B, the engagement formations 20, 20' are located along one longitudinal edge of the pallet forming member. The formations 20, 20' comprise upstanding projections 34, 34' adjacent the free edge of the pallet forming member with recesses 35, 35' immediately located inwardly of the projections 34, 34' respectively. The projection 34 is formed by a longitudinally extending web 36 stiffened by a plurality of transverse abutment ribs 37 and 38 located on either side of the web 36. Similarly, the projection 34' is formed by a longitudinally extending web 39 stiffened on the outer side by a transverse abutment rib 40. The projection 34 is configured to engage within the recess 35' and the projection 34' engages within the recess 35 when the edge engagement formations are moved together in the direction of the arrow (FIGS. 6A and 6B). When engaged together the respective surfaces 18 of the two pallet forming members are aligned and the pallet forming members cannot be separated by movement away from one another in a horizontal direction as depicted in FIGS. 6A and 6B. As is best shown in FIGS. 2, 3 and 4, the engagement formations 20, 20' are located on opposite sides of the transverse center line A—A such that their projections 34 and 34' respectively are oppositely directed. This arrangement enables a single mold to be used to form the pallet forming members 11, 12, 13 and 14 which are identical in shape in the embodiment illustrated.

FIGS. 7, 8 and 9 show in more detail the configuration of the corner boss members 15. The boss members 15 have a free abutment surface 41 which is located in the same plane as similar abutment surfaces on the other boss members 21, 22 and 23. In the assembled configuration (FIG. 1) the surfaces 41 of adjacent boss members 15 of separate pallet forming members engage against one another. To assist in locating the boss members when assembling the pallet construction, the boss members 15 further include a depending projection 42 of a U shaped construction with one drainage hole 27 communicating with the interior of the U shaped projection. The projection 42 has an outer wall dimension slightly smaller than but essentially the same shape as the adjacent recess 43 formed by stiffening ribs 44 and 45 within the boss member 15. Thus, when assembled such as in FIG. 1, the projection 42 of one pallet forming member engages within the recess 43 of the adjacent abutting pallet forming member to appropriately locate the pallet forming members relative to one another. The construction of the projection 42, however, does not obstruct drainage of water through the passages 27.

I claim:

1. A pallet comprising:

a plurality of generally identical pallet forming members arranged in two connected layers and forming a pallet bottom and a pallet top, each said pallet forming member having a width and a length substantially twice the width, and each said layer being constructed of said pallet forming members arranged side by side with the pallet forming members in one said layer being arranged at ninety degrees relative to the pallet forming members in the other said layer such that the four pallet sides are of substantially equal lengths.

2. The pallet according to claim 1 further comprising fastening means for fastening each said pallet forming member in one said layer to all of said pallet forming members in the other said layer.

3. The pallet according to claim 1 wherein each said pallet forming member is integrally molded from synthetic resin material.

4. The pallet according to claim 1 wherein each said pallet forming member comprises a substantially rectangular platform section with a first surface adapted to form a pallet outer surface, a second surface opposed to said first surface and adapted to form a pallet inner surface and a plurality of separate boss members extending from said second surface, said boss members being located generally at each corner of said platform section and generally at opposed longitudinal edges of said platform section midway along said longitudinal edges such that a free end of each said boss member of one said pallet forming member in one of said layers engages a free end of at least one said boss member in the other of said layers.

5. The pallet according to claim 4 wherein a first one of said longitudinal edges of each said pallet forming member includes engagement formations engageable with similar engagement formations on an adjacent said pallet forming member when assembled into the two layers, said engagement formations preventing separation of said pallet forming members by movement of said members away from one another in the same plane.

6. The pallet according to claim 5 wherein the second surface of the platform section of each said pallet forming member adjacent a second one of said longitudinal edges opposed to said first longitudinal edge diverges outwardly towards said second longitudinal edge such that said second longitudinal edge is substantially located in the plane of said first surface of the platform section.

7. The pallet according to claim 5 wherein said engagement formations on each said pallet forming member are formed by adjacent sections of equal length, and said engagement formations in said adjacent sections are oppositely directed.

8. The pallet according to claim 7 wherein two said sections of engagement formations are positioned on each said pallet forming member such that the engagement formations on either side of a transverse center line of the pallet forming member are oppositely directed.

9. The pallet according to claim 4 wherein at least one of said boss members on each said pallet forming member includes a projection configuration and a recess configuration such that in the pallet each projection configuration of said pallet forming member in one of said layers engages within a recess configuration of an adjacent said boss member and a pallet forming member in the other of said layers to locate said pallet forming members in position.

* * * * *